United States Patent [19]

Kuhnert et al.

[11] Patent Number: 4,533,046

[45] Date of Patent: Aug. 6, 1985

[54] WOUND BODY OR PACKAGE

[75] Inventors: Volker Kuhnert, Kerkrade, Netherlands; Franklin Niedrig, Berikon, Switzerland

[73] Assignee: Strapex AG, Wohlen, Switzerland

[21] Appl. No.: 624,147

[22] Filed: Jun. 25, 1984

[30] Foreign Application Priority Data

Jul. 19, 1983 [CH] Switzerland ..... 3939/83

[51] Int. Cl.[3] ..... B65D 85/67.5; B65D 85/67; B65D 71/02

[52] U.S. Cl. ..... 206/389; 242/67.1 R; 242/105; 242/DIG. 2

[58] Field of Search ..... 206/389; 242/DIG. 2, 242/67.1 R, 105

[56] References Cited

U.S. PATENT DOCUMENTS 610,339 9/1898 Atherton ..... 206/389

1,880,448 10/1932 Hickman ..... 206/389

*Primary Examiner*—William T. Dixson, Jr.

*Attorney, Agent, or Firm*—Werner W. Kleeman

[57] ABSTRACT

The wound body or package comprises a band or tape or the like which is wound thereon in the form of parallel windings or layers. At the central region of the wound package there is arranged a continuous or through-passing axial opening which is bounded by an inner winding layer of the wound band or tape. This inner winding layer together with the neighboring winding layers form a support body for the wound package. In this way there can be precluded the need to use any extraneous support body formed of a separate material.

14 Claims, 3 Drawing Figures

PRIOR ART

WOUND BODY OR PACKAGE

BACKGROUND OF THE INVENTION

The present invention relates to a new and improved construction of a wound body or package containing a wound-up band or tape or the like —herein usually simply referred to as a band— the wound body or package possessing a support body having a continuous or through-passing axial opening.

Wound packages or bodies are known to the art. They are fabricated by winding-up plastic bands or tapes upon a support body, such as a sleeve member, following the extruding, stretching and, if desired, fixing or setting of the band or the like. They serve for the orderly handling of the wound band from the time that it is fabricated until it is ultimately used. The support body of the wound body or package carries out a number of individual functions: it renders possible the build-up of the wound body or package, its removal from the winding mandrel, the subsequent storage of the wound body or package, the mounting at or association with a dispenser element and the removal of the wound band from the wound body or package, always while maintaining the predetermined order or arrangement of the wound coils or layers of the wound body or package. In order to be able to fulfill all these individual functions, especially to be able to withstand the pressure of the wound-up band, the support body must exhibit satisfactory strength.

The acquisition, storage and rendering available of such support bodies at the appropriate time for their use, imposes upon the manufacturer of the band or tape an expenditure which is extraneous to the actual tape fabrication or production operations. Moreover, the user of the band then is ultimately confronted with the presence of the empty support body which must be removed and eliminated, for instance incinerated or otherwise disposed of.

SUMMARY OF THE INVENTION

Therefore, with the foregoing in mind it is a primary object of the present invention to provide a new and improved construction of a wound body or package formed of a band or tape or the like wound thereon which does not require the use of any separate or external support body.

Yet another significant object of the present invention is directed to the provision of an improved wound body or package formed of a wound-up band or tape, wherein there is not required any separate support body for the winding and supporting of the band on the wound body or package, so that there is eliminated the need for acquiring, storage and ultimate removal and possible destruction of such support bodies.

A further important object of the present invention is concerned with the provision of a new and improved construction of a wound package formed of a band or tape coiled thereon, wherein the wound package essentially only contains the individual wound coils or layers of the wound-up band.

Yet another significant object of the present invention is directed to a new and improved construction of a wound body or package of the previously mentioned type, wherein the support body of the wound package, prior to winding-up the band, need not be separately manipulated or handled.

Now in order to implement these and still further objects of the present invention, which will become more readily apparent as the description proceeds, the wound package or body of the present development is manifested by the features that the support body essentially consists of the wound-up band.

Since the support body of the inventive wound body or package consists of the wound-up band or tape or the like, this support body can be advantageously formed in situ during winding-up of the band following the fabrication thereof and, furthermore, can be completely consumed by the end user of the wound-up body or package. In other words, the manufacturer of the inventive wound body or package is not compelled to acquire, store and make available the heretofore employed extraneous support body or element of the wound body or package and which support body or element had to be separately acquired. Furthermore, the end user of the wound package need not be concerned with removing the support body or element and disposing of the same. These advantages constitute both an economical saving and also are friendly to the environment since there is no need, for instance, to dispose of the support bodies, such as by incineration or burning thereof.

It is extremely surprising that the inventive wound body or package, even when containing parallel windings or wound layers or coils, is dimensionally stable without the use of any stable one-piece separate or external support body, particularly since separate or external support bodies possessing inadequate strength were deformed in the known wound bodies or packages.

It is thought and thus postulated that the dimensional strength of the inventive wound body or package is attributable to an equilibrium condition which arises between the pressure of the individual windings or the wound layers upon the support body and to the inherent tension of the wound layers of the support body. In the static condition, that is without the application of any external force, the individual windings or coils of the support body, i.e. the inner winding layers, function in the manner of a central reinforcement. Additionally, at the cross-over or reversal points of the superimposed windings or coils i.e. the wound layers which are wound so as to have opposite pitch, there arises a spatial grid which ensures for the spatial or three-dimensional stability in the manner of a spatial reinforcement and for the pressure compensation within the wound body or package.

The above-mentioned equilibrium condition also is retained during the removal of the finished-wound body or package from a winding mandrel or the like. Due to the engaging axially-parallel forces the wound package is transformed from a press fit into a sliding fit, while slightly enlarging the axial opening and correspondingly deforming the support body. The deformation which arises during the aforementioned enlargement or expansion brings about a reduction in the pitch angle of the windings or coils, i.e. the alignment thereof towards the normal to the axis. Due to this enlargement and such aforementioned alignment there is intensified the pressure exerted towards the outside by the support body, and thus, the reinforcement action. This, in turn, ensures for the dimensional stability of the wound body or package, notwithstanding the forces which engage thereat during the removal from the winding mandrel.

The same operation occurs during mounting of the wound package onto an expandable core or mandrel of a band withdrawal or dispensing device where axial displacement forces engage at the wound body or package. After termination of the action of the force, both during withdrawal as well as also during placement of the wound body or package onto the winding core, the windings or wound coils or layers return back into their original position and in that location ensure for the stability of the wound body in its rest condition or static state.

Since the wound package does not exhibit any separate or external support body, the inventive wound package not only can be employed in the manner of the heretofore known wound bodies or packages mounted upon band dispensing devices, but also can be beneficially used as a dispenser roll, i.e. the band can be withdrawn from the wound body or package itself, both from its periphery or circumference as well as from its center. This universal applicability affords an additional saving since the same winding body or package is available both for large consumers or customers who have available to them a band dispensing device and also small consumers or customers who contemplate manual removal of the band or tape from the wound body or package.

The inventive wound body is fabricated according to known techniques by winding-up the band or tape or the like, wherein, instead of using a winding spool or bobbin, there is employed a winding mandrel or cylinder which is part of the winding apparatus. The fixation of the starting portion of the band or the like to the winding mandrel or winding cylinder is accomplished by using an adhesive or by employing suitable constructional facilities or measures. The tension of the band, that is to say the torque or rotational moment of the wound package during the band winding-up operation, can be controlled with conventional, if desired, electronic means. Thus, in the case of extruded plastic bands as well as with the known wound packages possessing a separate or external support body, there is not produced any snug or tightly wound package, rather a relatively loose package, in order to render possible a subsequent shrinking of the band without deformation of the wound package.

The part of the inventive wound package which forms the support body or support core thereof can be formed by simply winding-up the band, i.e., by a band which has not undergone any additional treatment. In order to realize a more pronounced mutual adherence of the individual loops of the wound band and the individual windings or wound layers thereof the band can also be pre-treated at the region of the support body. A more pronounced mutual adhesion can be obtained by applying a suitable adherence-or adhesion-imparting agent or by increasing the inherent adherence or adhesion by means of a solvent or heat. As the adherence-or adhesion-applying agent there can be utilized, for instance, conventional, preferably liquid adhesives.

Following the winding up of the band, i.e., after the production of the wound body or package, the band end can be positionally fixed to safeguard it against undesired unravelling, and the wound body or package, as is conventional, can be provided with one or a number of packing or shipping bands for the subsequent transport or shipping thereof.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings pertaining to the inventive wound package there have been generally used the same reference characters to denote the same or analogous components and wherein.

DETAILED DESCRIPTION OF THE PREFERRED EMBODIMENTS

Figure 1:
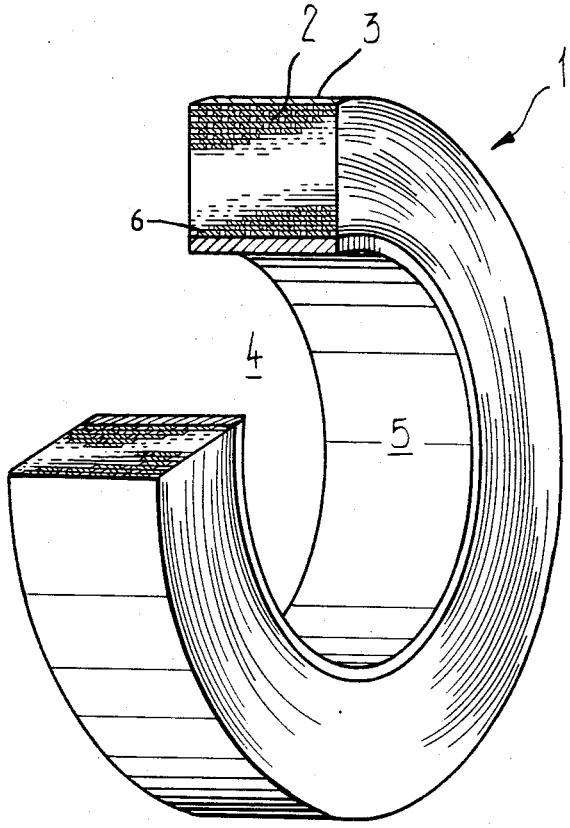
FIG. 1 is a perspective view of a wound body or package produced in accordance with the prior art and serving to facilitate the understanding of the present invention.

Describing now the drawings, in order to better understand the teachings of the present invention, reference will be made to a prior art construction of wound body or package 1 as shown in FIG. 1, wherein such conventional wound body or package 1 possess a band 3 which is wound-up into parallel windings 2. At the central region there is provided at the wound body or package 1 a continuous axial opening 4 which is bounded by a separate support body 5, for instance formed of cardboard, wherein such support body 5 bears against the innermost or first wound layer or coil 6 of the wound body or package 1.

Figure 2:
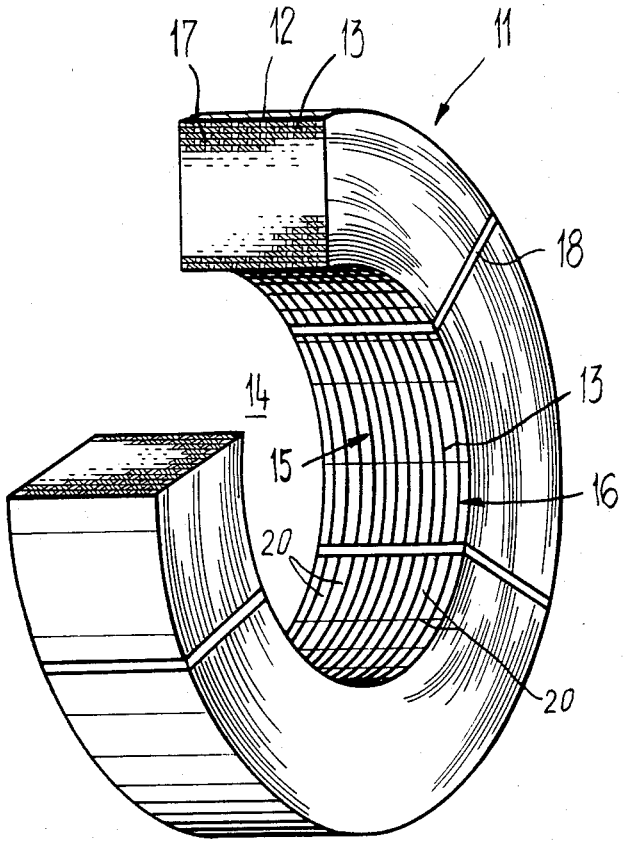
FIG. 2 is a perspective view of a wound body or package produced according to the present invention.
Figure 3:
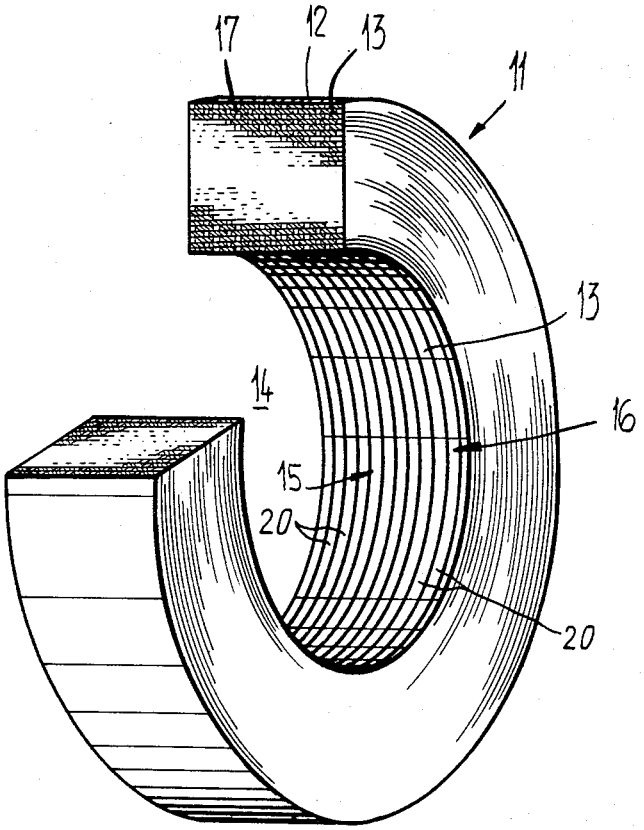
FIG. 3 is a perspective view of a further embodiment of a wound body or package produced according to the present invention.

Turning attention now to the inventively formed wound bodies or packages 11 as shown in FIGS. 2 and 3, it will be observed that each such wound package 11 also comprises a band or tape 13 or the like which is wound-up into parallel windings or wound coils or layers 12. The continuous or through-passing axial opening 14 of each of the wound bodies or packages 11, shown in FIGS. 2 and 3, is bounded or delimited in each case by the innermost or first winding layer 16 which, in conjunction with the following winding or wound layers 17, forms an inherent support body 15. The adhesion of these inner winding layers 16 and 17 to one another and which form the support body 15 is intensified with the arrangement of FIG. 3 by the use of a suitable adhesive.

During the formation of the wound bodies or packages 11, depicted in FIGS. 2 and 3, the band or tape 13 or the like is wound onto the winding mandrel or core of the conventional winder or winding machine such that a plurality of loops 20 of the band 13 are wound adjacent one another in each wound layer or coil, with the confronting edges of each band loop preferably in contact with one another. The adjacent loops 20 of each wound layer or coil extend in the axial direction of the winding mandrel and each such loop 20 of course encircles the outer surface or circumference of the winding mandrel. This first wound layer or coil 16 composed of the juxtapositioned and mutually contacting band loops 20 has a first direction or handedness of winding or pitch, viewed in the axial or lengthwise direction of the winding mandrel, whereupon there is wound in like fashion, but with opposite pitch and in the opposite direction, the next winding layer or coil 17 likewise composed of the plurality of adjacent loops 20. This process is repeated back and forth axially of the winding mandrel until the desired amount of the band 13 has been wound up in successive windings or wound layers 12 to form the wound body or package 11.

The windings or wound layers or coils 12 of the wound package 11 shown in FIG. 2 are shown encircled with three packing or shipping bands or the like, in order to ensure that the wound package 11 does not undesirably unravel and to afford an unproblematic transport or shipping of the thus formed wound body or package 11.

The inventive constructions of wound bodies or packages 11 can be formed of flexible bands or tapes of the most different type, for instance formed of textile materials, composite or compound materials and preferably of plastic bands having a smooth or structured surface. Such band may constitute a foil band or a strapping band for the wrapping or strapping of articles, such as packages. It will be understood that since the support body of the inventive wound packages itself is also formed of such flexible materials, these wound bodies or packages of the present development possess an increased elasticity in contrast to the known wound bodies or packages employing a rigid separate or external support body.

The inventive constructions of wound bodies or packages not only afford a saving in materials which are usually foreign to the manufacturer of the bands as well as bringing about ecological advantages as heretofore discussed, but additionally dispense with the logistic operations otherwise needed for the acquisition of a separate or external support body as heretofore required with the prior art constructions of wound bodies or packages.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. In a wound package composed of a wound-up band and a support body for supporting the wound-up band and possessing a continuous axial opening, the improvement which comprises:

forming the support body essentially from the wound-up band; and the band being wound onto the wound package such that the latter contains a plurality of essentially parallel windings formed of the wound-up band.

2. The wound package as defined in claim 1, wherein: said wound package possesses an essentially cylindrical configuration.

3. The wound package as defined in claim 1, wherein: said band comprises a foil band.

4. The wound package as defined in claim 1, wherein: the band comprises a strapping band.

5. The wound package as defined in claim 1, wherein: said band possesses a smooth surface.

6. The wound package as defined in claim 1, wherein: the band possesses a structured surface.

7. The wound package as defined in claim 1, wherein: the band of the wound package is wound such that there are formed wound layers which at the region of the support body are interconnected with one another.

8. The wound package as defined in claim 7, wherein: the wound layers are interconnected with one another by an adhesive at the region of the support body.

9. The wound package as defined in claim 7, wherein: the wound layers are thermally connected with one another at the region of the support body.

10. The wound package as defined in claim 7, wherein:

the winding layers are connected with one another at the region of the support body by a solvent.

11. The wound package as defined in claim 1, wherein:

the band is wound into the wound package such that it can be unravelled therefrom at the periphery of the wound package.

12. A wound package comprising:

a wound-up band;

a support body having a continuous axial opening for supporting the wound-up band;

said wound-up band being wound-up so as to form the wound package such that there are formed a plurality of overlapping winding layers;

each of said winding layers being composed of adjacent mutually contacting loops having a predetermined pitch, with the band loops of an immediately next adjacent winding layer having the loops thereof wound with opposite pitch and in an opposite direction; and said support body essentially comprising wound-up winding layers of the wound-up band.

13. A wound package formed by winding-up a band, comprising:

a first coil layer wound from a plurality of parallel windings of the band with a helical pitch of predetermined handedness;

a second coil layer wound from a plurality of parallel windings of the band with a helical pitch of a handedness opposite in the sense to said predetermined handedness; and said parallel windings of said first layer cooperating with said parallel windings of said second layer to form a support means for subsequent coil layers of the wound package.

14. The wound package as defined in claim 13, further including:

subsequent coil layers alternately wound from pluralities of parallel windings of the band with helical pitches of alternating handedness.

* * * * *